US007686285B2

(12) United States Patent
Murray et al.

(10) Patent No.: US 7,686,285 B2
(45) Date of Patent: Mar. 30, 2010

(54) ENVIRONMENTAL CHAMBER AND ULTRASONIC NEBULIZER ASSEMBLY THEREFOR

(75) Inventors: Michael Louis Murray, Franklin Park, IL (US); Bradley William Stone, Yorkville, IL (US)

(73) Assignee: Barnstead Thermolyne Corporation, Dubuque, IA (US)

( * ) Notice: Subject to any disclaimer, the term of this patent is extended or adjusted under 35 U.S.C. 154(b) by 1142 days.

(21) Appl. No.: 11/087,209

(22) Filed: Mar. 23, 2005

(65) Prior Publication Data

US 2006/0213508 A1 Sep. 28, 2006

(51) Int. Cl.
*B01F 3/04* (2006.01)

(52) U.S. Cl. ..... 261/81; 261/DIG. 48

(58) Field of Classification Search ..... 261/81, 261/DIG. 48

See application file for complete search history.

(56) References Cited

U.S. PATENT DOCUMENTS

| | | | | | |
|---|---|---|---|---|---|
| 3,469,785 | A | * | 9/1969 | Boucher et al | 239/4 |
| 3,561,444 | A | | 2/1971 | Boucher | 128/194 |
| 4,031,171 | A | | 6/1977 | Asao et al. | 261/1 |
| 4,731,204 | A | | 3/1988 | Noma et al. | 261/30 |
| 4,738,806 | A | | 4/1988 | Noma et al. | 261/81 |
| 4,746,466 | A | | 5/1988 | Takahashi | 261/30 |
| 4,776,990 | A | | 10/1988 | Verity | 261/128 |
| 4,807,810 | A | * | 2/1989 | Ando | 236/44 A |
| 4,911,866 | A | | 3/1990 | Monroe | 261/81 |
| 4,951,661 | A | | 8/1990 | Sladek | 128/202.27 |
| 4,986,937 | A | * | 1/1991 | Sorio | 261/81 |
| 5,003,518 | A | | 3/1991 | Felder | 368/5 |
| 5,116,088 | A | | 5/1992 | Bird | 285/319 |
| 5,158,716 | A | * | 10/1992 | Hirokane | 261/142 |
| 5,176,856 | A | | 1/1993 | Takahashi et al. | 261/142 |
| 5,217,165 | A | | 6/1993 | Takahashi et al. | 239/102.2 |
| 5,247,989 | A | | 9/1993 | Benevelli | 165/30 |
| 5,300,260 | A | | 4/1994 | Keshet et al. | 261/81 |
| 5,407,604 | A | | 4/1995 | Luffman | 261/4 |
| 5,447,059 | A | | 9/1995 | Miller et al. | 73/116 |
| 6,102,992 | A | * | 8/2000 | Berg et al. | 96/361 |
| 6,357,671 | B1 | | 3/2002 | Cewers | 239/102.2 |
| 6,726,186 | B2 | * | 4/2004 | Gaaloul et al. | 261/81 |
| 2005/0212152 | A1 | * | 9/2005 | Reens | 261/81 |
| 2006/0131764 | A1 | * | 6/2006 | Weon | 261/81 |

FOREIGN PATENT DOCUMENTS

| | | | |
|---|---|---|---|
| FR | 2 690 510 | * | 10/1993 |
| JP | 52-8220 | * | 1/1977 |
| JP | 3-105140 | * | 5/1991 |

* cited by examiner

*Primary Examiner*—Scott Bushey
(74) *Attorney, Agent, or Firm*—Wood, Herron & Evans, LLP

(57) ABSTRACT

An environmental chamber includes an ultrasonic nebulizer assembly for controlling the relative humidity within the chamber. The ultrasonic nebulizer assembly is connected in closed-loop fluid communication with an enclosed chamber of the environmental chamber and includes an ultrasonic nebulizer module to generate water vapor that is introduced into the enclosed chamber. The ultrasonic nebulizer module is constructed to be immersed in water within the ultrasonic nebulizer assembly and is readily replaceable by the user. A nebulizer hour timer is provided to monitor the length of time of the ultrasonic nebulizer is operating to provide a precise indication to the user of how much life is left in the ultrasonic nebulizer before it needs to be replaced.

50 Claims, 5 Drawing Sheets

ENVIRONMENTAL CHAMBER AND ULTRASONIC NEBULIZER ASSEMBLY THEREFOR

FIELD OF THE INVENTION

The present invention relates generally to humidification systems and, more particularly, to a humidification system for use in an environmental chamber to control the relative humidity within the environmental chamber during testing of products within the chamber.

BACKGROUND OF THE INVENTION

Environmental chambers are designed to provide accurate environmental control of temperature and relative humidity within the chamber for use in ICH pharmaceutical stability testing, genetic studies, chromatography tests, tissue culture studies and other research and development applications such as shelf life tests and packaging, paper products or electronic component breakdown, for example. Environmental chambers typically include a heating and refrigeration control system to control the temperature within the enclosed internal chamber and a humidification system to control the relative humidity within the chamber. The products placed within the enclosed chamber are subjected to a predetermined temperature and relative humidity over a period of time to determine the reaction of the product and/or its packaging to prolonged exposure to various temperature and relative humidity ranges.

In the past, environmental chambers have controlled the relative humidity within the chamber through humidification systems incorporating water spray nozzles or atomizers for example. The spray nozzles or atomizers are designed to inject water droplets into the air flow path of the chamber in which the water droplets are mixed with forced air generated from air outside of the enclosed chamber. The mixture of the water droplets and forced air produce a moist air that is introduced into the enclosed chamber to thereby control the relative humidity within the chamber.

Conventional spray nozzles and atomizers used in known environmental chambers typically form water droplets that are not uniform in size so that both smaller and larger water droplets are mixed with the forced air introduced into the enclosed chamber. The larger water droplets are not readily absorbed by the air within the chamber so that it is oftentimes difficult to precisely and reliably control the relative humidity within the chamber at a predetermined relative humidity setpoint. Also, the larger droplets have a tendency to accumulate on the walls of the enclosed chamber and eventually the droplets form a puddle of water on the floor of the chamber which is undesirable.

Therefore, there is a need for an environmental chamber having a humidification system that provides for precise and reliable control of the relative humidity within the chamber.

There is also a need for an environmental chamber having a humidification system that provides for efficient humidification of the chamber air without causing undesirable accumulation of water droplets within the chamber.

SUMMARY OF THE INVENTION

The present invention overcomes the foregoing and other shortcomings and drawbacks of environmental chambers and humidification systems for humidifying the chamber air heretofore known. While the invention will be described in connection with certain embodiments, it will be understood that the invention is not limited to these embodiments. On the contrary, the invention includes all alternatives, modifications and equivalents as may be included within the spirit and scope of the present invention.

In accordance with the principles of the present invention, an environmental chamber having an enclosed internal chamber is provided with a humidification system in the form of an ultrasonic nebulizer assembly. In one embodiment, the ultrasonic nebulizer assembly is connected in closed-loop fluid communication with the enclosed chamber so that a closed-loop air flow path is provided between the ultrasonic nebulizer assembly and the enclosed chamber. The ultrasonic nebulizer assembly is configured to generate water vapor, preferably having water droplets in the micron range, and introduce the water vapor into the enclosed chamber for controlling the relative humidity within the chamber.

The ultrasonic nebulizer assembly of the present invention includes an enclosed water reservoir in which water is introduced and maintained under float control. The ultrasonic nebulizer assembly also includes a replaceable ultrasonic nebulizer module that is configured to be immersed in the water within the enclosed reservoir. The ultrasonic nebulizer module includes an ultrasonic nebulizer and its associated electrical circuitry that are encapsulated in an electrically insulative and water-proof potting compound. The ultrasonic nebulizer is selectively energized by a power supply to generate the water vapor that is introduced into the enclosed chamber.

In one embodiment, an environmentally protected fan is mounted within the enclosed reservoir of the ultrasonic nebulizer assembly and is selectively energized by the same power supply that energizes the ultrasonic nebulizer module. The fan draws air from the enclosed chamber and forces the drawn air into contact with the water vapor within the enclosed reservoir. The water vapor is carried by the forced air and introduced into the enclosed chamber. The fan allows for pressurization of the humidified area in the enclosed reservoir for recirculating and humidifying the atmosphere of the enclosed chamber when there is a demand for relative humidity.

According to another aspect of the present invention, a breakwall is provided in the enclosed reservoir that effectively separates the enclosed reservoir into a float section and a nebulizing section. A float control switch is positioned within the float section and the ultrasonic nebulizer module is positioned in the nebulizing section. The breakwall functions to isolate the float switch from the water turbulence generated by the ultrasonic nebulizing module to minimize undesirable bouncing of the float switch.

A baffle member is mounted in the enclosed reservoir so that it faces the ultrasonic nebulizing module. When the ultrasonic nebulizer module is operating, a water spout is created directly above the ultrasonic nebulizer. The baffle member is configured to contain the water spout so that larger droplets are redirected back into the reservoir while allowing the forced air to carry only the atomized water vapor into the enclosed chamber. The baffle member also prevents water droplets formed in the water spout above the ultrasonic nebulizer from splashing onto the environmentally protected fan.

According to another aspect of the prevent invention, the environmental chamber includes a relative humidity controller to control the relative humidity within the enclosed chamber. The relative humidity controller is electrically coupled to the power supply that energizes both the ultrasonic nebulizer and the fan. When the relative humidity controller determines there is a demand for relative humidity, the power supply is turned "ON" to simultaneously energize both the ultrasonic nebulizer and the fan. The fan is turned "ON" and "OFF" at the same time the ultrasonic nebulizer is turned "ON" and "OFF" so that water vapor is not introduced into the enclosed chamber when there is no demand for relative humidity.

The environmental chamber of the present invention includes a nebulizer hour timer to monitor the length of time that the ultrasonic nebulizer is operating. The timer increments in hours and tenths of an hour when the ultrasonic nebulizer is operating so that the timer is independent of the run time of the environmental chamber. The timer includes an hour-accumulator display to provide the user with a precise indication of how much life is left in the ultrasonic nebulizer module before it needs to be replaced. A timer reset microswitch is provided to reset the nebulizer hour timer following replacement of the ultrasonic nebulizer module.

According to yet another aspect of the present invention, the ultrasonic nebulizer assembly is connected to a source of water and a common drain through flexible tubing. The free ends of the flexible tubing are provided with quick disconnect fittings that are accessible by the user at the rear of the environmental chamber. The quick disconnect fittings are actuatable by one hand of the user and automatically close to prevent leakage from the ultrasonic nebulizer assembly when the flexible tubing is disconnected from the enclosed water reservoir.

The environmental chamber and ultrasonic nebulizer assembly of present invention provide for precise and reliable control of the relative humidity within the chamber. The environmental chamber and ultrasonic nebulizer assembly of present invention also provide for efficient humidification of the chamber air without causing undesirable accumulation of water droplets within the chamber.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE PREFERRED EMBODIMENT

Figure 1:
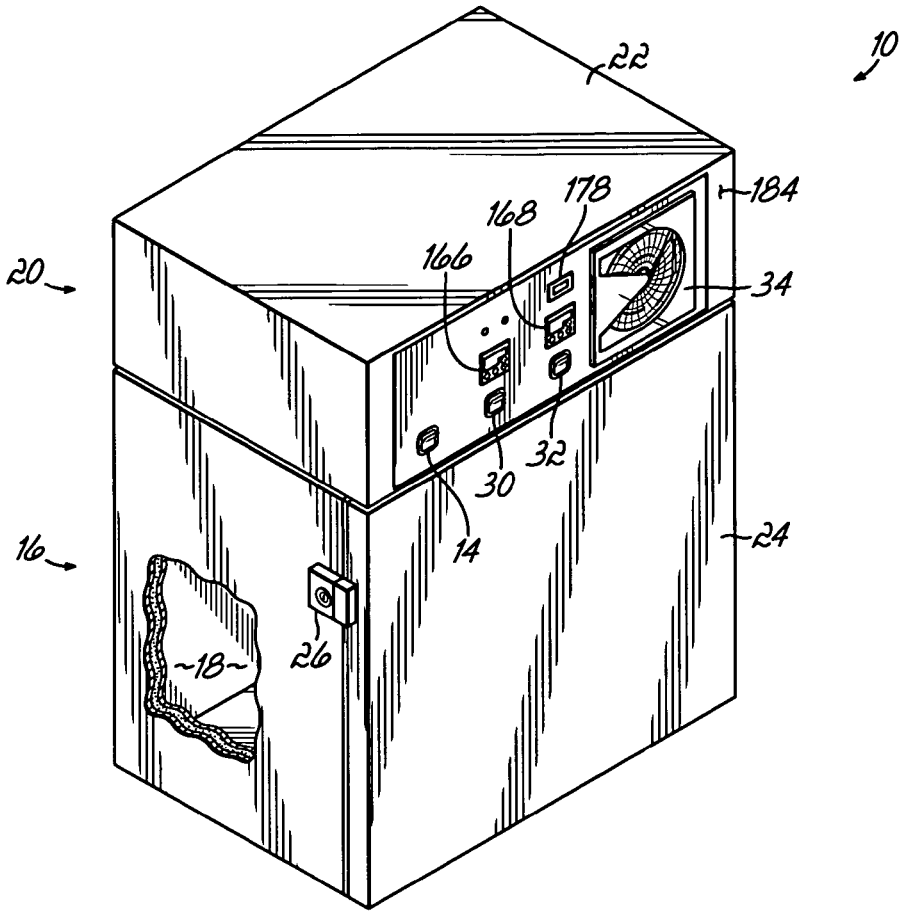
FIG. 1 is a perspective view of an environmental chamber incorporating a humidification system in the form of an ultrasonic nebulizer assembly in accordance with the principles of the present invention.

Referring to the figures, and to FIG. 1 in particular, an environmental chamber 10 is shown in accordance with one embodiment of the present invention. Environmental chamber 10 is connected to a power source 12 (FIGS. 8 and 9) and is activated by the user through a front panel power switch 14. As will be described in greater detail below, the environmental chamber 10 is designed to provide accurate environmental control of temperature and relative humidity within the chamber 10 for use, by way of example, in ICH pharmaceutical stability testing, genetic studies, chromatography tests, tissue culture studies and other research and development applications such as shelf life tests and packaging, paper products or electronic component breakdown.

According to one aspect of the present invention, the environmental chamber 10 includes a lower chamber section 16 having an enclosed internal chamber 18 (FIG. 1) made of stainless steel or other suitable material and an upper control section 20 having a removable top cover 22. The enclosed chamber 18 is sealed by a hinged door 24 and includes one or more shelves, racks or other support structure (not shown) mounted therein for supporting various products (not shown) placed within the enclosed chamber 18. A key-operated door lock 26 may be provided to secure the contents of the chamber 10 during an environmental test.

Figure 2:
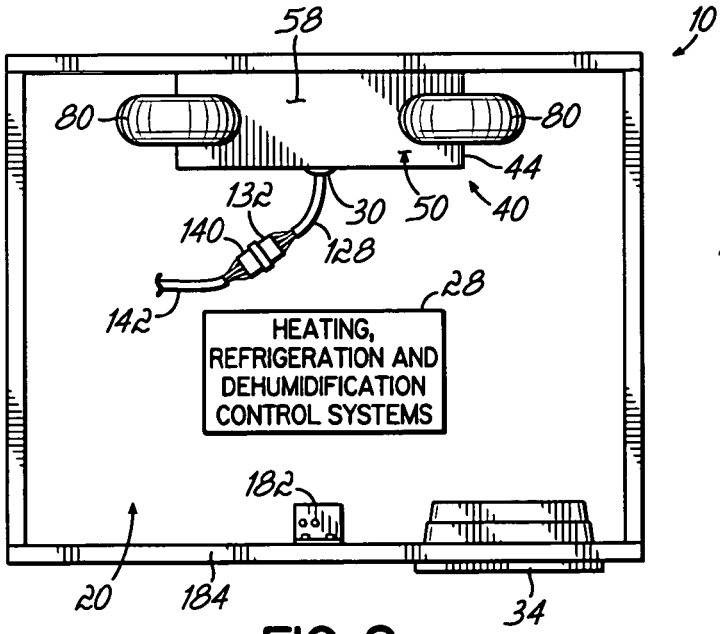
FIG. 2 is a top plan view of the environmental chamber shown in FIG. 1 with its top cover removed, illustrating the location of the ultrasonic nebulizer assembly within an upper control section of the environmental chamber.

As shown diagrammatically in FIG. 2, the environmental chamber 10 includes a control system 28, including a heating control system and optional refrigeration and dehumidification control systems that are mounted in the upper control section 20 of the environmental chamber 10. These control systems are readily accessible by the user when the top cover 22 is removed. The heating control system is activated when the front panel power switch 14 of the environmental chamber 10 is turned "ON" and the optional refrigeration and dehumidity control systems are activated by the user through a pair of front panel refrigeration and dehumidity switches 30 and 32, respectively. A chart recorder 34 may be provided for recording the actual chamber temperature and relative humidity within the enclosed chamber 18 during an environmental test.

Figure 8:
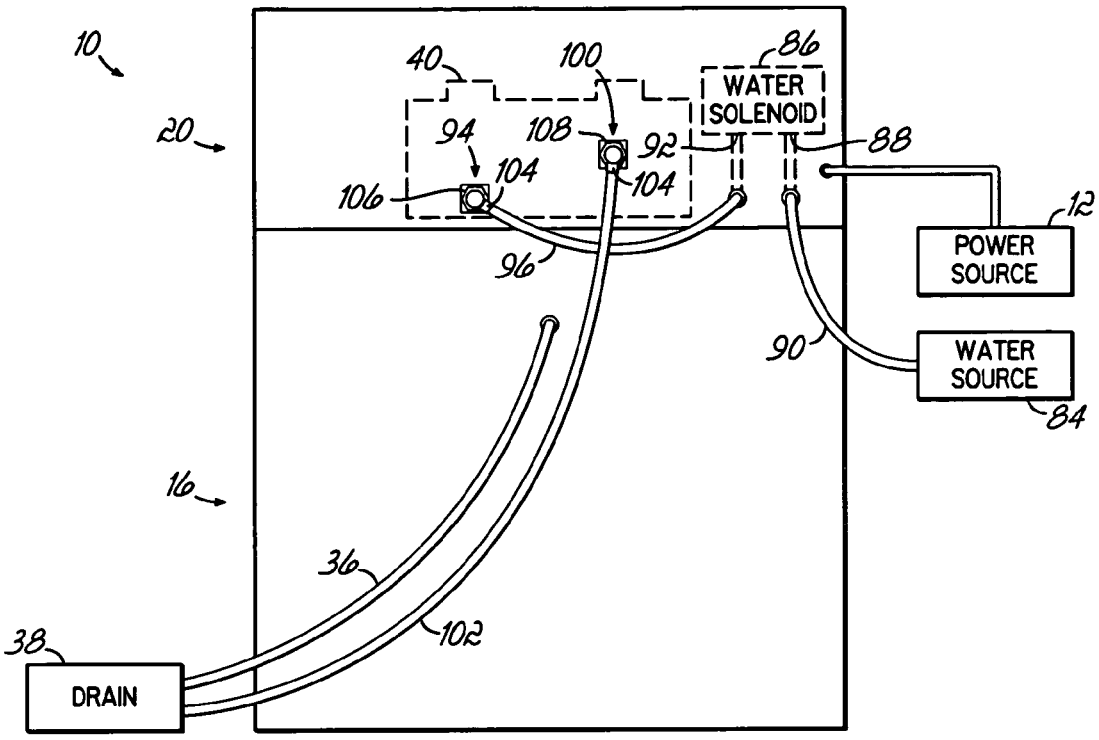
FIGS. 8 and 9 are rear elevational views of the environmental chamber shown in FIG. 1, illustrating alternative connections of the ultrasonic nebulizer assembly of the present invention with a source of water and a common drain.
Figure 9:
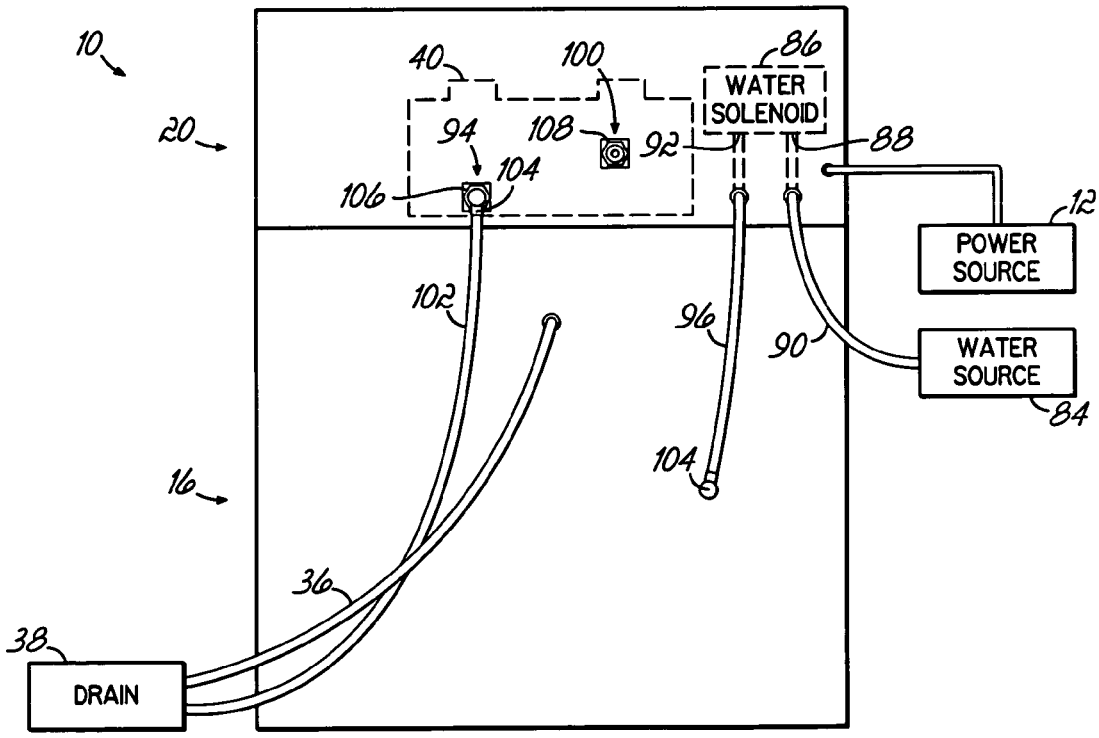

As will be readily understood by those of ordinary skill in the art, the heating and refrigeration control systems include heating elements (not shown), a condenser (not shown) and an evaporator coil (not shown) that are operable to control the temperature within the enclosed chamber 18, such as temperatures ranging from about 0° C. to about 50° C. by way of example. The dehumidification control system includes a dehumidification coil (not shown) that condenses moist air within the enclosed chamber 18 so as to maintain the humidity within the chamber 18 at or below ambient conditions. The condensate is drained out of the chamber 18 through a drain pan (not shown) that is connected by flexible tubing 36 to a common drain 38 (FIGS. 8 and 9). The environmental chamber 10 also includes a floor drain (not shown) that exits the enclosed chamber 18 near the bottom of its rear wall (not shown) and is connected to the common drain 38.

In accordance with the principles of the present invention, the relative humidity (RH) within the enclosed chamber 18 is controlled by a humidification system in the form of an ultrasonic nebulizer assembly 40 that is connected in fluid communication with the enclosed chamber 18 as will be described in greater detail below. As shown in FIG. 2, the ultrasonic nebulizer assembly 40 is mounted within the upper control section 20 of the environmental chamber 10 and is readily accessible by a user when the top cover 22 is removed. As described in detail below, the ultrasonic nebulizer assembly 40 is configured to generate water vapor, represented generally by numeral 42 in FIGS. 6 and 7, and introduce the water vapor 42 into the enclosed chamber 18 to thereby control the relative humidity within the enclosed chamber 18 while products are undergoing environmental test.

Figure 3:
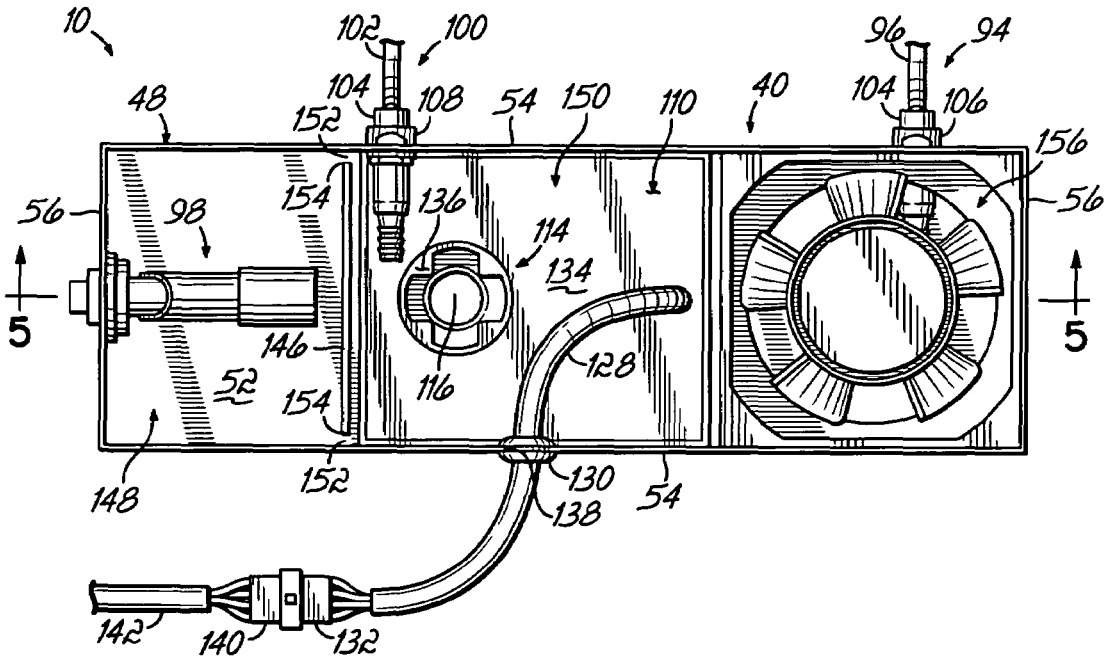
FIG. 3 is a top plan view of the ultrasonic nebulizer assembly of the present invention with its top cover removed, illustrating the ultrasonic nebulizer assembly in an "OFF" state.
Figure 4:
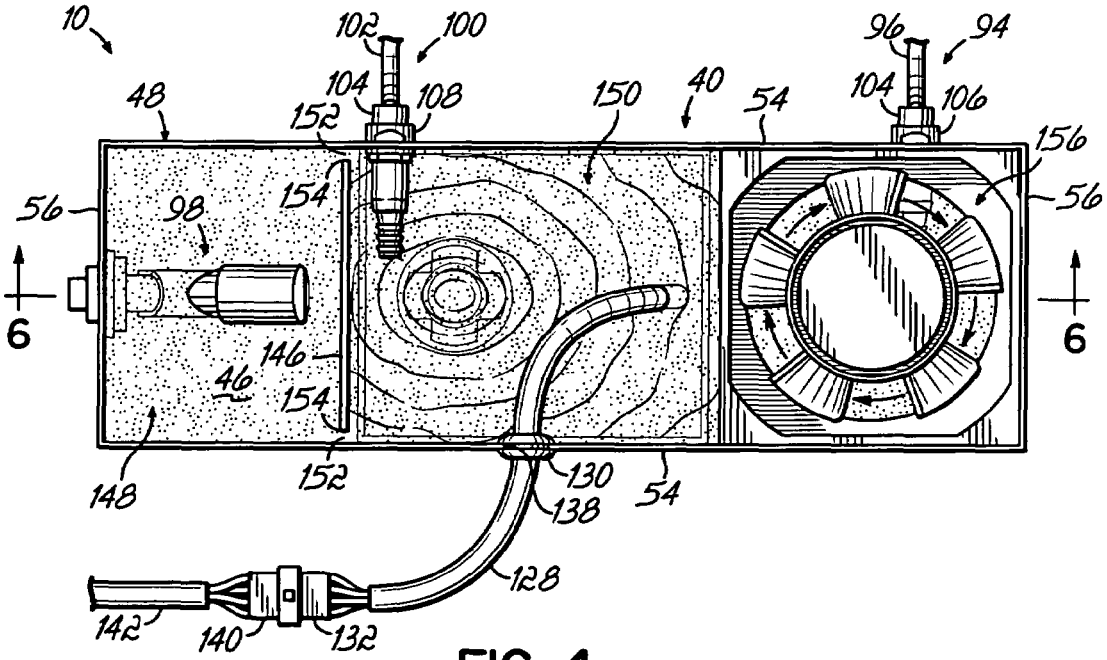
FIG. 4 is a view similar to FIG. 3, illustrating the ultrasonic nebulizer assembly in an "ON" state.
Figure 5:
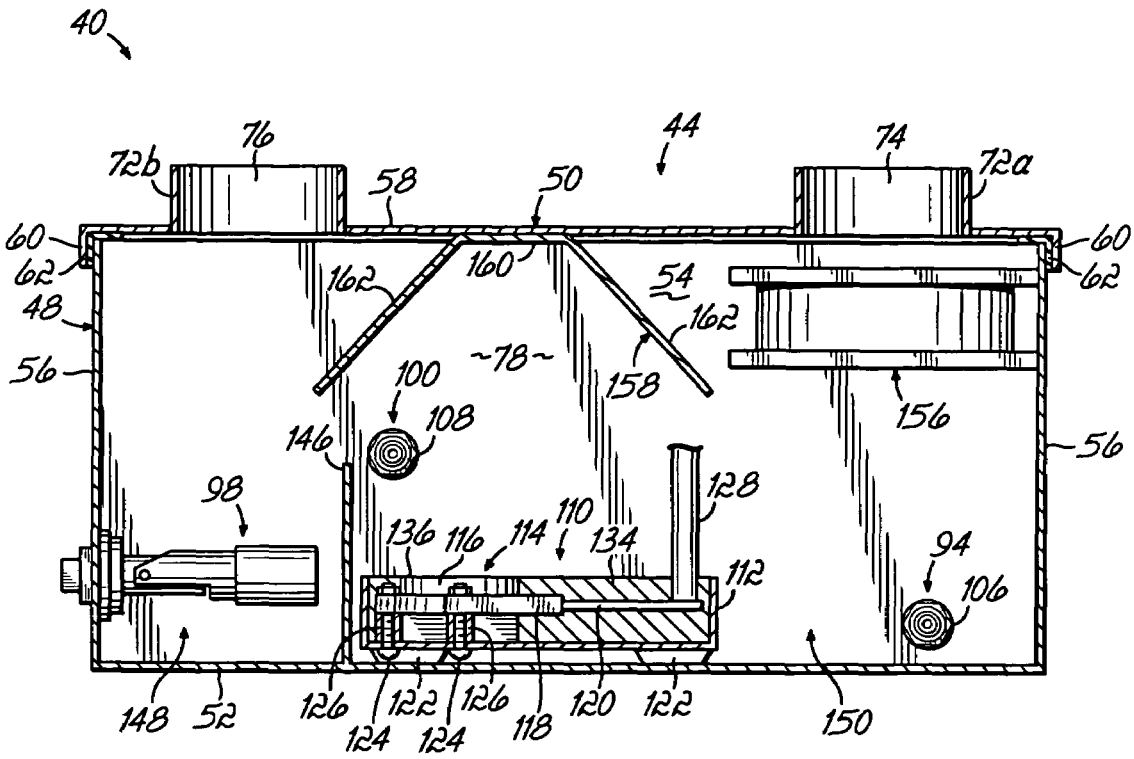
FIG. 5 is a side elevation view, partially in cross-section, of the ultrasonic nebulizer assembly shown in FIG. 3.
Figure 6:
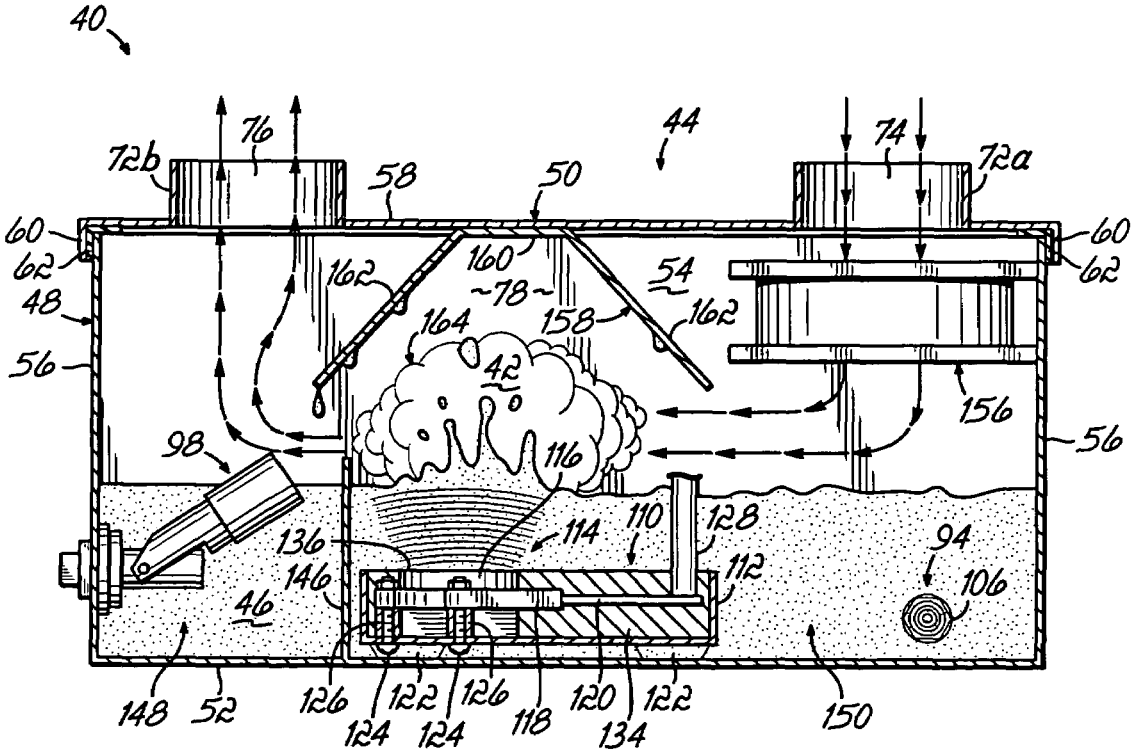
FIG. 6 is a side elevation view, partially in cross-section, of the ultrasonic nebulizer assembly shown in FIG. 4.
Figure 7:
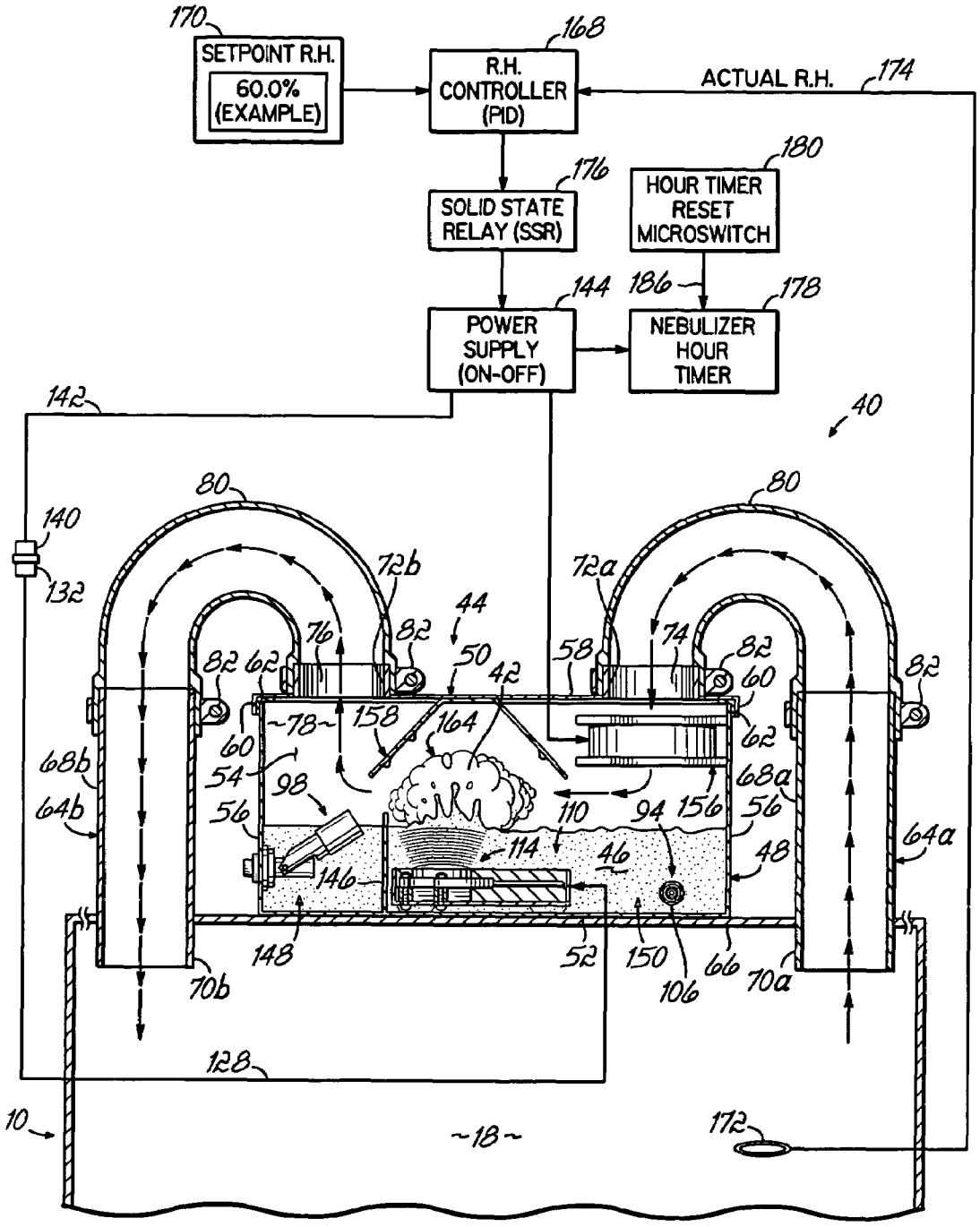
FIG. 7 is a diagrammatic view illustrating control system for operating the ultrasonic nebulizer assembly of the present invention.

Referring now to FIGS. 3-7, the ultrasonic nebulizer assembly 40 is shown according to one embodiment of the present invention. The ultrasonic nebulizer assembly 40 includes an enclosed water reservoir 44 made of stainless steel or other suitable material in which deionized water, represented by numeral 46 in FIGS. 4, 6 and 7, is introduced and maintained under float control. In one embodiment, the enclosed reservoir 44 includes a main water reservoir 48 and a removable top cover 50 that is secured to the main water reservoir 48 through a set of cover screws (not shown). The main water reservoir 48 has a bottom wall 52, a pair of upstanding side walls 54 and a pair of upstanding end walls 56. The top cover 50 includes a top wall 58, a skirt wall 60 and a sealing gasket 62 attached to a lower side of the top wall 58 that forms a generally air and water tight seal with an upper peripheral edge of the main water reservoir 48 when the top cover 50 is secured to the main water reservoir 48 as shown in FIGS. 5-7.

In one embodiment of the present invention, the ultrasonic nebulizer assembly 40 is connected in closed-loop fluid communication with the enclosed chamber 18 so that a closed-loop air flow path is provided between the ultrasonic nebulizer assembly 40 and the enclosed chamber 18. As shown in FIG. 7, the environmental chamber 10 includes a pair of spaced apart vertical tubes 64*a*, 64*b* made of stainless steel or other suitable material that extend through a top wall 66 of the enclosed chamber 18 and are positioned generally toward the rear of the enclosed chamber 18. Each tube 64*a*, 64*b* has a respective upper section 68*a*, 68*b* that extends above the top wall 66 and a lower section 70*a*, 70*b* that extends below the top wall 66 and into the enclosed chamber 18. In one embodiment, each tube 64*a*, 64*b* has a diameter of about 1½" although other diameters of the tubes 64*a*, 64*b* are possible as well.

Further referring to FIGS. 2 and 5-7, the top cover 50 of the ultrasonic nebulizer assembly 40 has a pair of tubular extensions 72*a*, 72*b* that extend upwardly from the top wall 58 so as to provide an inlet 74 and an outlet 76 in fluid communication with the interior space 78 of the ultrasonic nebulizer assembly 40. In one embodiment, each tubular extension 72*a*, 72*b* has a diameter of about 1½" although other diameters of the tubular extensions 72*a*, 72*b* are possible as well.

The tubular extensions 72*a*, 72*b* are connected to the respective upper sections 68*a*, 68*b* of the tubes 64*a*, 64*b* through a pair of generally J-shaped hoses 80. In one embodiment, the pair of hoses 80 are made of vinyl although other materials are possible as well. The hoses 80 are fitted over the respective tubular sections 72*a*, 72*b* and tubes 64*a*, 64*b* and are secured thereto by hose clamps 82. The tube 64*a* functions as an air intake from the enclosed chamber 18 through which air is drawn from the enclosed chamber 18 and introduced into the ultrasonic nebulizer assembly 40 through the inlet 74. The tube 64*b* functions as an air exhaust through which water vapor 42 from the ultrasonic nebulizer assembly 40 is introduced into the enclosed chamber 18 from the outlet 76. Of course, other configurations, locations and connections of the ultrasonic nebulizer assembly 40 are possible as well without departing from the spirit and scope of the present invention.

Referring to FIGS. 8 and 9, the main water reservoir 48 is connected to a source 84 of deionized water through a float-controlled water inlet valve 86, such as a solenoid-controlled water valve by way of example. It will be appreciated that while deionization of the water is preferred through use of a deionization cartridge (not shown), the water may not be deionized from the water source 84 in other embodiments. The water source 84 is connected to an inlet 88 of the water inlet valve 86 through flexible tubing 90, such as ¼" flexible tubing in one embodiment. The outlet 92 of the water inlet valve 86 is connected to a water inlet or fill port 94 located generally near the bottom of the main water reservoir 48 so that water is introduced into the main water reservoir 48 through flexible tubing 96 when the water inlet valve 86 is opened. The water inlet or fill port 94 also serves as a drain port to drain water from the main water reservoir 48 as will be described in greater detail below.

The level of the water 46 within the main water reservoir 48 is controlled by a pivotal float switch 98 that extends into the main water reservoir 48 and is electrically coupled to the water inlet valve 86. When the water level within the main water reservoir 48 falls below a predetermined level, the falling float switch 98 causes the water inlet valve 86 to open so that water is introduced into the main water reservoir 48 through the flexible tubing 96. When the predetermined water level is reached, the rising float switch 98 causes the water inlet valve 86 to close. In this way, the level of water within the main water reservoir 48 is accurately maintained at or near a predetermined level.

Further referring to FIGS. 8 and 9, the main water reservoir 48 also includes a water outlet or overflow port 100 that is connected through similar flexible tubing 102 to the common drain 38. The water outlet or overflow port 100 is positioned to drain excess water from the main water reservoir 48 in the event the water level should rise some extent above the desired level maintained by the float switch 98. In the event of a system malfunction, the overflow port 100 assures that water within the main water reservoir 48 will not overflow into the upper control section 20 of the environmental chamber 10 which may otherwise cause damage to electrical systems of the environmental chamber 10.

In one embodiment, the water fill/drain port 94 and the water overflow port 100 are accessible by the user at the rear of the environmental chamber 10. The free ends of the flexible tubing 96 and 102 are each provided with a 90° elbow fitting 104 and the water fill/drain port 94 and the water overflow port 100 are each provided with a quick disconnect fitting 106 and 108, respectively. The quick disconnect fittings 106 and 108 are actuatable by one hand of the user and automatically close to prevent water leakage from the main water reservoir 48 when the flexible tubing 96 and 102 are disconnected from the water inlet/drain port 94 and water overflow port 100. One suitable quick disconnect fitting for use in the present invention is commercially available from Industrial Specialties of Englewood, Colo. and designated Part No. CPC-C1-S-A31-PP. One suitable elbow fitting for use in the present invention is commercially available from Colder Products of St. Paul, Minn. and designated Part No. PMC2104. Of course, other commercially available quick disconnect and elbow fittings, as well as other types and configurations of fittings, are possible as well.

In accordance with the principles of the present invention, the ultrasonic nebulizer assembly 40 includes a replaceable ultrasonic nebulizer module 110 that is configured to be immersed in the water 46 within the main water reservoir 48.

As will be described in greater detail below, the ultrasonic nebulizer module 110 is operable to generate the water vapor 42 (FIGS. 6 and 7) within the enclosed reservoir 44 with the water vapor 42 preferably having water droplets in the micron range. The water vapor 42 is then introduced into the enclosed chamber 18 to control the relative humidity within the environmental chamber 10. The water droplets produced by the ultrasonic nebulizer module 110 of the present invention are very small as compared to the water droplets generated by conventional humidification systems employing spray nozzles and atomizers. The water vapor 42 is thus much more rapidly introduced and absorbed into the enclosed chamber 18. The ultrasonic nebulizer module 110 of the present invention also minimizes or eliminates the undesirable formation and accumulation of water droplets within the enclosed chamber 18.

In one embodiment, as shown in FIGS. 5-7, the ultrasonic nebulizer module 110 includes an open-top tray 112 that supports an ultrasonic nebulizer 114 and its associated electrical circuitry within the tray 112. As is well known in the art, the ultrasonic nebulizer 114 includes an oscillating disk 116 (FIGS. 3 and 4) that is supported by a rigid ultrasonic nebulizer housing 118 (FIGS. 5-7). The electrical circuitry is mounted on a printed circuit board 120 in close proximity to the housing 118 and is operable to drive the oscillating disk 116 in the MHz range. In one embodiment, the disk 116 is driven to oscillate at about 1.2 MHz, although other oscillating frequencies of the disk 116 are possible as well. One suitable ultrasonic nebulizer 114 for use in the present invention is commercially available from APC Products of Pleasant Gap, Pa. and designated Part No. 50-1025, although other commercially available ultrasonic nebulizers are possible as well. The ultrasonic nebulizer 114 may have a water vapor output of about 350 cc/hr and a rated life of 10,000 hours. Rubber feet 122 (FIGS. 5 and 6) are provided on the bottom of the tray 112 to reduce undesirable vibrational movement of the ultrasonic nebulizer module 110 within the enclosed reservoir 44 as will be described in greater detail below.

During assembly of the ultrasonic nebulizer module 110, the ultrasonic nebulizer 114 and its associated printed circuit board 120 are mounted within the tray 112 through fasteners 124 (FIGS. 5 and 6) that extend upwardly from the bottom of the tray 112. The fasteners 124 extend upwardly through upstanding spacers 126 (FIGS. 5 and 6) that are positioned between the bottom of the tray 112 and the ultrasonic nebulizer housing 118. A water-proof power cord 128 having an annular grommet 130 positioned thereabout is electrically coupled to the printed circuit board 120 and has its free end provided with an electrical connector 132.

The oscillating disk 116 is temporarily covered with foil (not shown) or other barrier material while an electrically insulative and water-proof potting compound 134 is poured into the tray 112 to encapsulate the ultrasonic nebulizer housing 118 and the associated printed circuit board 120. The potting compound 134 may be a urethane, silicone, epoxy or other suitable material that does not expand, contract or heat up excessively during its setting or curing stage. Following the potting process to encapsulate the housing 118 and printed circuit board 120, the foil (not shown) is removed so that the disk 116 and a top 136 of the ultrasonic nebulizer housing 118 are exposed as shown in FIG. 3. In this way, the ultrasonic nebulizer module 110 is configured to be immersed in the water 46 contained within the main water reservoir 48 with the water-proof power cord 128 extending outside of the enclosed reservoir 44. In one embodiment, the ultrasonic nebulizer 114 is positioned about 1.2" below the level of the water 46 within the main water reservoir 48 although other depths of the ultrasonic nebulizer 114 are possible as well.

Figure 3A:
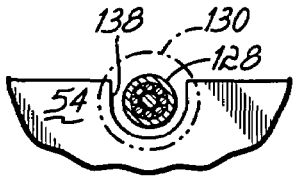
FIG. 3A is an enlarged side elevational view of the circled area 3A in FIG. 3.

As shown in FIG. 3A, the annular grommet 130 provided on the water-proof power cord 128 is configured to be positioned in a generally semi-circular notch 138 formed in the upper edge of one of the side walls 54. The grommet 130 forms a generally air and water tight seal with the one side wall 54 of the ultrasonic nebulizer assembly 40 when the ultrasonic nebulizer module 110 is installed within the main water reservoir 48.

Referring to FIGS. 2 and 7, the electrical connector 132 provided on the water-proof power cord 128 is releasably connectable with a mating electrical connector 140 provided on a free end of a power cord 142 that is connected to a 48 VAC power supply 144 (FIG. 7). The mating electrical connectors 132 and 140 permit the ultrasonic nebulizer module 110 to be easily disconnected from the power supply 144 by the user after a predetermined period of use, such as 5,000 hours for example, and then replaced with a new ultrasonic nebulizer module 110 that is then connected to the power supply 144 as will be described in greater detail below.

In one embodiment as shown in FIGS. 3-7, the main water reservoir 48 includes an upstanding breakwall 146 that effectively separates the main water reservoir 48 into a float section 148 and a nebulizing section 150. The breakwall 146 is made of stainless steel and extends upwardly from the bottom wall 52 so as to form a pair of gaps 152 (FIGS. 3 and 4) between its opposite side edges 154 and the side walls 54 of the main water reservoir 48. In one embodiment, the gaps 152 are each about 1/16" although other configurations of the breakwall 146 and other widths of the gaps 152 are possible as well.

The float control switch 98 is positioned within the float section 148 and the ultrasonic nebulizer module 110 is positioned within the nebulizer section 150. The gaps 152 permit a constant water level to be maintained within the float and nebulizer sections 148, 150 while the breakwall 146 functions to isolate the float switch 98 from the water turbulence generated by the ultrasonic nebulizer 114 when it is operating. Without the breakwall 146, the water turbulence generated by the ultrasonic nebulizer 114 could cause the float switch 98 to "bounce" while near the fill level, and this could cause rapid activation-deactivation or "chatter" of the water inlet valve or solenoid 86 which is undesirable. The breakwall 146 minimizes this bouncing effect by effectively separating the turbulent nebulizer section 150 from the non-turbulent float section 148. This allows the float switch 98 to be mounted in close proximity to the ultrasonic nebulizer module 110 without undesirable bouncing of the float switch 98 during operation of the ultrasonic nebulizer 114.

In accordance with another aspect of the present invention, an environmentally protected fan 156 is mounted within the enclosed reservoir 44 to draw air from the enclosed chamber 18 through the air intake tube 64*a*. The fan 156 forces this drawn air into contact with the water vapor 42 within the enclosed reservoir 44 so that the water vapor 42 is carried by the forced air and introduced into the enclosed chamber 18 through the air exhaust tube 64*b*. The fan 156 allows for pressurization of the humidified area in the enclosed reservoir 44 for recirculating and humidifying the atmosphere of the enclosed chamber 18 when there is an RH demand (i.e., the ultrasonic nebulizer 114 is "ON"). The air intake and air exhaust tubes 64*a* and 64*b* are positioned within the enclosed chamber 18 to prevent pressurization and subsequent air flow into the enclosed chamber 18 when RH is not required (i.e., the ultrasonic nebulizer 114 is "OFF"). When the ultrasonic nebulizer 114 is in its "OFF" state, the air flow across the ultrasonic nebulizer assembly 40 is negligible thereby preventing further humidification of the enclosed chamber 18 when RH is not required.

In one embodiment, the fan 156 is mounted within the enclosed reservoir 44 below the inlet 74 and above the level of water 46 so that its axis of rotation is generally aligned with the axis of the inlet 74. Of course, other orientations and locations of the fan 156, and other types of forced air devices, are possible as well. One suitable environmentally protected fan 156 for use in the present invention is commercially available from Comair Rotron of San Diego, Calif. and designated Model No. SU2B-E1, although other commercially available fans are possible as well. The fan 156 is turned "ON" only when the ultrasonic nebulizer module 114 is turned "ON" by the power supply 144 as will be described in greater detail below.

In accordance with another aspect of the present invention as shown in FIGS. 5-7, a baffle member 158 is supported by the top cover 50 and faces the ultrasonic nebulizer module 110. In one embodiment, the baffle member 158 is made of stainless steel and has an upside-down "flattened-V" cross-sectional shape. The baffle member 158 includes a central web 160 and a pair of flanges 162 extending at oblique angles from opposite ends of the central web 160. When the ultrasonic nebulizer 114 is operating to generate the water vapor 42, a water spout 164 is created directly above the ultrasonic nebulizer 114. The baffle member 158 is configured to contain the water spout 164 so that larger water droplets are redirected back into the main water reservoir 48 while allowing the forced air flow to carry only the nebulized water vapor 42 into the enclosed chamber 44. In this way, the baffle member 158 prevents a "puddling" effect of water within the enclosed chamber 18 which would otherwise occur. Without the baffle member 158, water would build up in the enclosed chamber 18 as a water collection near the rear wall (not shown) of the chamber 18 and subsequently on the floor (not shown) of the chamber 18 which is undesirable. The baffle member 158 also prevents water droplets formed in the water spout 164 above the ultrasonic nebulizer 114 from splashing onto the environmentally protected fan 156.

Referring now to FIGS. 1 and 7, the temperature within the enclosed chamber 18 is controlled by a temperature controller 166 (FIG. 1). The temperature controller 166 includes a user interface that permits a user to program the desired temperature set-point within the enclosed chamber 18. The temperature controller 166 also includes a user display that displays both the programmed temperature set-point as well the actual temperature within the enclosed chamber 18. A temperature sensor (not shown) is coupled to the temperature controller 166 that senses the actual temperature within the enclosed chamber 18 and applies a signal to the temperature controller 166 indicative of the actual chamber temperature. As will be understood by those skilled in the art, the temperature controller 166 is operable to maintain the temperature within the enclosed chamber 18 at or near the programmed temperature set-point. One suitable temperature controller 166 for use in the present invention is commercially available from Watlow of Winona, Minn. and designated Model No. 96, although other commercially available temperature controllers are possible as well.

Further referring to FIGS. 1 and 7, the environmental chamber 10 also includes a relative humidity (RH) PID controller 168 to control the relative humidity within the enclosed chamber 18. The RH PID controller 168 includes a user interface that permits a user to program the desired RH set-point 170 (FIG. 7) within the enclosed chamber 18. The RH PID controller 168 also includes a user display that displays both the programmed RH set-point 170 as well the actual RH within the enclosed chamber 18. An RH sensor 172 (FIG. 7) is coupled to the RH PID controller 168 that senses the actual RH within the enclosed chamber 18 and applies a signal 174 (FIG. 7) to the RH PID controller 168 indicative of the actual RH within the enclosed chamber 18. One suitable humidity controller 168 for use in the present invention is commercially available from Watlow of Winona, Minn. and designated Model No. 96, although other commercially available humidity controllers are possible as well. One suitable humidity sensor 172 for use in the present invention is commercially available from Vaisala of Helsinki, Finland and designated the "HUMITTER™", although other commercially available humidity sensors are possible as well.

As shown in FIG. 7, the RH PID controller 168 is coupled to the 48 VAC power supply 144 through a solid state relay 176. The RH PID controller 168 is operable to turn the power supply 144 "ON" when the actual RH within the enclosed chamber 18 is below the programmed RH set-point 170, i.e., there is an RH demand. In one embodiment, the signal generated by the RH PID controller 168 is based on a 5-second cycle time. When a demand signal for RH is generated by the RH PID controller 168, the power supply 144 is turned "ON" to simultaneously energize both the ultrasonic nebulizer 114 and the fan 156. In response to operation of the power supply 144, the ultrasonic nebulizer 114 operates in an "instant-on" and "instant-off" manner so that the water vapor 42 is generated immediately when the power supply 144 is turned "ON" and immediately stops when the power supply 144 is turned "OFF". The fan 156 is turned "ON" and "OFF" by the power supply 144 at the same time the ultrasonic nebulizer 114 is turned "ON" and "OFF" so that the water vapor 42 is not introduced into the enclosed chamber 18 when there is no RH demand. The operation of the ultrasonic nebulizer 114 and fan 156 in this manner prevents RH set-point overshooting and provides precise RH control.

According to another aspect of the present invention, a nebulizer hour timer 178 is provided to monitor the length of time that the ultrasonic nebulizer 114 is operating. The timer 178 is energized by the power supply 144 only when the power supply 144 is turned "ON" by the RH PID controller 168 to simultaneously energize the fan 156 and the ultrasonic nebulizer 114. The timer 178 increments in seconds and fractions of a second only when the ultrasonic nebulizer 114 is operating so that the timer 178 is independent of the run time of the environmental chamber 10. The timer 178 includes a battery-operated hour-accumulator display to provide the user with a precise indication of how much life is left in the ultrasonic nebulizer module 110 before it needs to be replaced as described in detail below. Without a true indicator of the operational running time of the ultrasonic nebulizer 114, a user could conceivably miss the recommended replacement time of the ultrasonic nebulizer, such as 5,000 hours for example, and the environmental chamber 10 could stop humidifying without any forewarning. For drug stability testing for example, the unexpected stoppage of humidification could be very costly.

When the recommended life of the ultrasonic nebulizer 114 has been reached, the ultrasonic nebulizer module 110 is designed to be easily replaced by the user. To this end, the user removes the top cover 22 of the environmental chamber 10 to expose the ultrasonic nebulizer assembly 40 located in the upper control section 20. The user loosens the pair of hose clamps 82 holding the vinyl hoses 80 to the top cover 50 of the enclosed reservoir 44 and slides the hose clamps 82 toward the other ends of the vinyl hoses 80. The vinyl hoses 80 are removed from the top cover 50 which is then removed from the ultrasonic nebulizer assembly 40 by removing the cover screws (not shown). The annular grommet 130 on the power cord 128 is unseated from the notch 138 and the spent ultrasonic nebulizer module 110 is disconnected from the power supply 144 by disconnecting the mating electrical connectors 132 and 140. The ultrasonic nebulizer module 110 is then removed from the main water reservoir 48 and discarded.

A new ultrasonic nebulizer module 110 is immersed in the water 46 within the main water reservoir 48 and the annular grommet 130 on the power cord 128 is seated in the notch 138. The top cover 50 is replaced and secured to the main water reservoir 48 through the cover screws (not shown) and the new ultrasonic nebulizer module 110 is then connected to the power supply 144 by connecting the mating electrical connectors 132 and 140. The vinyl hoses 80 are then reconnected to the top cover 50 through the pair of hose clamps 82.

Figure 2A:
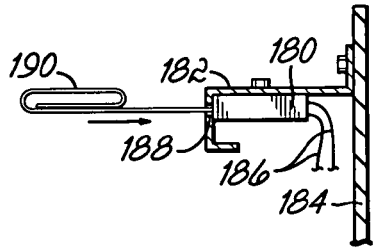
FIG. 2A is an enlarged side elevational view of the circled area 2A in FIG. 2.

In accordance with another aspect of the present invention, a timer reset micro-switch 180 (FIGS. 2, 2A and 7) is provided in the upper control section 20 of the environmental chamber 10 to reset the nebulizer hour timer 178 following replacement of the ultrasonic nebulizer module 110. The timer reset micro-switch 180 is supported by a bracket 182 (FIGS. 2 and 2A) mounted to a front wall 184 of the environmental chamber 10 and is electrically coupled to the nebulizer hour timer 178 through electrical leads 186 (FIGS. 2A and 7). The bracket 182 has an aperture 188 formed therethrough (FIG. 2A) that permits a user to insert a bent paperclip 190 or other instrument through the aperture 188 to activate the micro-switch 180 and thereby reset the timer 178. The timer 178 is now ready to monitor the operational running time of the new ultrasonic nebulizer module 110 in accordance with the principles of the present invention. Finally, the top cover 22 of the environmental chamber 10 is replaced.

Due to the immersible construction of the ultrasonic nebulizer module 110 as described in detail above, the user is not required to drain the main water reservoir 48 during replacement of the ultrasonic nebulizer module 110. If draining of the main water reservoir 48 is desired by the user for maintenance or other purposes, the user first disconnects the flexible tubing 96 from the water inlet/drain port 94 by manually actuating the quick disconnect fitting 106 as shown in FIG. 9. The quick disconnect fitting 106 automatically closes to prevent water from leaking through the water fill/drain port 94. The flexible tubing 102 is then disconnected from the water overflow port 100 and re-connected with the water inlet/drain port 94 as shown in FIG. 9 so that the water inlet/drain port 94 is now connected to the common drain 38. The water 46 within the main water reservoir 48 drains through the flexible tubing 102 to the common drain 38. Thereafter, the flexible tubing 96 and 102 are re-connected to the water inlet/drain port 94 and water overflow port 100, respectively, as shown in FIG. 8 to resume normal water flow operation of the ultrasonic nebulizer assembly 40.

While the present invention has been illustrated by the description of an exemplary embodiment thereof, and while the embodiment has been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicants' general inventive concept.

What is claimed is:

1. An environmental chamber, comprising:

an enclosed chamber configured to receive a product therein; and an ultrasonic nebulizer assembly connected in closed-loop fluid communication with the enclosed chamber, the ultrasonic nebulizer assembly comprising:

an enclosed reservoir configured to contain water therein and having an inlet connected to the enclosed chamber through an air intake conduit extending between the inlet and the enclosed chamber and an outlet connected to the enclosed chamber through an air exhaust conduit extending between the outlet and the enclosed chamber, the enclosed reservoir being connected in fluid communication with the enclosed chamber so that a closed-bog air flow path is provided between the ultrasonic nebulizer assembly and the enclosed chamber;

an ultrasonic nebulizer module configured to be immersed in the water within the reservoir and operable to generate water vapor within the reservoir for introduction into the enclosed chamber through the outlet; and a forced air device located within the closed-loop air flow path and being operable to move the water vapor into the enclosed chamber.

2. The environmental chamber of claim 1, wherein the forced air device is mounted within the ultrasonic nebulizer assembly.

3. The environmental chamber of claim 1, wherein the forced air device is operable to draw air into the reservoir from the enclosed chamber.

4. The environmental chamber of claim 1, wherein the forced air device comprises a fan.

5. The environmental chamber of claim 1, wherein the ultrasonic nebulizer module comprises:

a tray:

a ultrasonic nebulizer device supported by said tray;

electrical circuitry operable to drive the ultrasonic nebulizer device; and an electrically insulative and water-proofing potting material encapsulating at least a portion of the ultrasonic nebulizer device and the electrical circuitry.

6. The environmental chamber of claim 1, further comprising:

a water inlet valve in fluid communication with the reservoir and configured to be connected in fluid communication with a source of water for selectively introducing water into the reservoir; and a float electrically coupled to the water inlet valve and configured to float on a surface of the water within the reservoir;

the water inlet valve and float cooperating to maintain a predetermined water level within the reservoir.

7. The environmental chamber of claim 6, wherein the enclosed reservoir comprises:

a float section containing the float therein;

a nebulizing section containing the ultrasonic nebulizer assembly therein; and a wall at least partially separating the float section and the nebulizing section.

8. The environmental chamber of claim 6, further comprising a water inlet port in fluid communication with the reservoir and configured to be connected in fluid communication with the water inlet valve.

9. The environmental chamber of claim 8, wherein the water inlet port includes a quick disconnect connector configured to be connected in fluid communication with the water inlet valve.

10. The environmental chamber of claim 6, further comprising a water outlet port in fluid communication with the reservoir and configured to be connected in fluid communication with a drain.

11. The environmental chamber of claim 10, wherein the water outlet port includes a quick disconnect connector configured to be connected in fluid communication with the drain.

12. The environmental chamber of claim 1, further comprising a baffle member supported within the reservoir and facing the ultrasonic nebulizer module in spaced relationship therefrom.

13. The environmental chamber of claim 12, wherein the baffle member comprises:

a central web;

a first flange extending downwardly and away from the central web at one end of the central web; and a second flange extending downwardly and away from the central web at an opposite end of the central web.

14. The environmental chamber of claim 1, further comprising a timer operable to display time indicia corresponding to an operating time of the ultrasonic nebulizer module.

15. An environmental chamber, comprising:

an enclosed chamber configured to receive a product therein; and an ultrasonic nebulizer assembly connected in closed-loop fluid communication with the enclosed chamber, the ultrasonic nebulizer assembly comprising:

an enclosed reservoir configured to contain water therein and having an inlet connected to the enclosed chamber through an air intake conduit extending between the inlet and the enclosed chamber and an outlet connected to the enclosed chamber through an air exhaust conduit extending between the outlet and the enclosed chamber, the enclosed reservoir being connected in fluid communication with the enclosed chamber so that a closed-loop air flow path is provided between the ultrasonic nebulizer assembly and the enclosed chamber;

an ultrasonic nebulizer module configured to be immersed in the water within the reservoir and operable to generate water vapor within the reservoir for introduction into the enclosed chamber through the outlet; and a fan mounted within the enclosed reservoir, the fan being operable to draw air from the enclosed chamber into the reservoir through the inlet and move the water vapor into the enclosed chamber through the outlet.

16. The environmental chamber of claim 15, wherein the ultrasonic nebulizer module comprises:

a tray:

a ultrasonic nebulizer device supported by said tray;

electrical circuitry operable to drive the ultrasonic nebulizer device; and an electrically insulative and water-proofing potting material encapsulating at least a portion of the ultrasonic nebulizer device and the electrical circuitry.

17. The environmental chamber of claim 15, further comprising:

a water inlet valve in fluid communication with the reservoir and configured to be connected in fluid communication with a source of water for selectively introducing water into the reservoir; and a float electrically coupled to the water inlet valve and configured to float on a surface of the water within the reservoir;

the water inlet valve and float cooperating to maintain a predetermined water level within the reservoir.

18. The environmental chamber of claim 17, wherein the enclosed reservoir comprises:

a float section containing the float therein;

a nebulizing section containing the ultrasonic nebulizer assembly therein; and a wall at least partially separating the float section and the nebulizing section.

19. The environmental chamber of claim 17, further comprising a water inlet port in fluid communication with the reservoir and configured to be connected in fluid communication with the water inlet valve.

20. The environmental chamber of claim 19, wherein the water inlet port includes a quick disconnect connector configured to be connected in fluid communication with the water inlet valve.

21. The environmental chamber of claim 17, further comprising a water outlet port in fluid communication with the reservoir and configured to be connected in fluid communication with a drain.

22. The environmental chamber of claim 21, wherein the water outlet port includes a quick disconnect connector configured to be connected in fluid communication with the drain.

23. The environmental chamber of claim 15, further comprising a baffle member supported within the reservoir and facing the ultrasonic nebulizer module in spaced relationship therefrom.

24. The environmental chamber of claim 23, wherein the baffle member comprises:

a central web;

a first flange extending downwardly and away from the central web at one end of the central web; and a second flange extending downwardly and away from the central web at an opposite end of the central web.

25. The environmental chamber of claim 15, further comprising a timer operable to display time indicia corresponding to an operating time of the ultrasonic nebulizer module.

26. An environmental chamber, comprising:

an enclosed chamber configured to receive a product therein; and an ultrasonic nebulizer assembly connected in closed-loop fluid communication with the enclosed chamber, the ultrasonic nebulizer assembly comprising:

an enclosed reservoir configured to contain water therein and having an inlet connected to the enclosed chamber through an air intake conduit extending between the inlet and the enclosed chamber and an outlet connected to the enclosed chamber through an air exhaust conduit extending between the outlet and the enclosed chamber, the enclosed reservoir being connected in fluid communication with the enclosed chamber so that a closed-bog air flow path is provided between the ultrasonic nebulizer assembly and the enclosed chamber;

an ultrasonic nebulizer module configured to be immersed in the water within the reservoir and operable to generate water vapor within the reservoir for introduction into the enclosed chamber; and a forced air device located within the closed-loop air flow path and being operable to move the water vapor into the enclosed chamber;

a controller;

a sensor electrically coupled to the controller and operable to detect a relative humidity within the enclosed chamber; and a power supply electrically coupled to the controller, the ultrasonic nebulizer module and the forced air device;

the controller being responsive to the sensor to selectively energize the ultrasonic nebulizer module and the forced air device with the power supply to generally maintain a predetermined relative humidity within the enclosed chamber.

27. The environmental chamber of claim 26, wherein the forced air device is mounted within the ultrasonic nebulizer assembly.

28. The environmental chamber of claim 26, wherein the forced air device is operable to draw air into the reservoir from the enclosed chamber.

29. The environmental chamber of claim 26, wherein the forced air device comprises a fan.

30. The environmental chamber of claim 26, wherein the power supply is electrically coupled to the ultrasonic nebulizer module through a releasably engageable electrical connector.

31. An ultrasonic nebulizer assembly, comprising:

an enclosed reservoir having an inlet and an outlet and configured to contain water therein;

an ultrasonic nebulizer module configured to be immersed in the water within the reservoir and operable to generate water vapor within the reservoir;

a forced air device mounted within the enclosed reservoir and operable to draw air into the reservoir through the inlet and move the water vapor through the outlet; and a timer operable to display time indicia corresponding to an operating time of the ultrasonic nebulizer module.

32. The ultrasonic nebulizer assembly of claim 31, wherein the forced air device comprises a fan.

33. The ultrasonic nebulizer assembly of claim 31, wherein the ultrasonic nebulizer module comprises:

a tray:

a ultrasonic nebulizer device supported by said tray;

electrical circuitry operable to drive the ultrasonic nebulizer device; and an electrically insulative and water-proofing potting material encapsulating at least a portion of the ultrasonic nebulizer device and the electrical circuitry.

34. The ultrasonic nebulizer assembly of claim 31, further comprising:

a water inlet valve in fluid communication with the reservoir and configured to be connected in fluid communication with a source of water for selectively introducing water into the reservoir; and a float electrically coupled to the water inlet valve and configured to float on a surface of the water within the reservoir;

the water inlet valve and float cooperating to maintain a predetermined water level within the reservoir.

35. The ultrasonic nebulizer assembly of claim 34, wherein the enclosed reservoir comprises:

a float section containing the float therein;

a nebulizing section containing the ultrasonic nebulizer assembly therein; and a wall at least partially separating the float section and the nebulizing section.

36. The ultrasonic nebulizer assembly of claim 34, further comprising a water inlet port in fluid communication with the reservoir and configured to be connected in fluid communication with the water inlet valve.

37. The ultrasonic nebulizer assembly of claim 36, wherein the water inlet port includes a quick disconnect connector configured to be connected in fluid communication with the water inlet valve.

38. The ultrasonic nebulizer assembly of claim 34, further comprising a water outlet port in fluid communication with the reservoir and configured to be connected in fluid communication with a drain.

39. The ultrasonic nebulizer assembly of claim 38, wherein the water outlet port includes a quick disconnect connector configured to be connected in fluid communication with the drain.

40. The ultrasonic nebulizer assembly of claim 31, further comprising a baffle member supported within the reservoir and facing the ultrasonic nebulizer module in spaced relationship therefrom.

41. The ultrasonic nebulizer assembly of claim 40, wherein the baffle member comprises:

a central web;

a first flange extending downwardly and away from the central web at one end of the central web; and a second flange extending downwardly and away from the central web at an opposite end of the central web.

42. An ultrasonic nebulizer assembly, comprising:

an enclosed reservoir having an inlet and an outlet and configured to contain water therein;

an ultrasonic nebulizer module configured to be immersed in the water within the reservoir and operable to generate water vapor within the reservoir;

a forced air device mounted within the enclosed reservoir and operable to draw air into the reservoir through the inlet and move the water vapor through the outlet; and a baffle member supported within the reservoir and facing the ultrasonic nebulizer module in spaced relationship therefrom, the baffle member comprising:

a central web;

a first flange extending downwardly and away from the central web at one end of the central web; and a second flange extending downwardly and away from the central web at an opposite end of the central web.

43. The ultrasonic nebulizer assembly of claim 42, wherein the forced air device comprises a fan.

44. The ultrasonic nebulizer assembly of claim 42, wherein the ultrasonic nebulizer module comprises:

a tray:

a ultrasonic nebulizer device supported by said tray;

electrical circuitry operable to drive the ultrasonic nebulizer device; and an electrically insulative and water-proofing potting material encapsulating at least a portion of the ultrasonic nebulizer device and the electrical circuitry.

45. The ultrasonic nebulizer assembly of claim 42, further comprising:

a water inlet valve in fluid communication with the reservoir and configured to be connected in fluid communication with a source of water for selectively introducing water into the reservoir; and a float electrically coupled to the water inlet valve and configured to float on a surface of the water within the reservoir;

the water inlet valve and float cooperating to maintain a predetermined water level within the reservoir.

46. The ultrasonic nebulizer assembly of claim 45, wherein the enclosed reservoir comprises:

a float section containing the float therein;

a nebulizing section containing the ultrasonic nebulizer assembly therein; and a wall at least partially separating the float section and the nebulizing section.

47. The ultrasonic nebulizer assembly of claim 45, further comprising a water inlet port in fluid communication with the reservoir and configured to be connected in fluid communication with the water inlet valve.

48. The ultrasonic nebulizer assembly of claim 47, wherein the water inlet port includes a quick disconnect connector configured to be connected in fluid communication with the water inlet valve.

49. The ultrasonic nebulizer assembly of claim 45, further comprising a water outlet port in fluid communication with the reservoir and configured to be connected in fluid communication with a drain.

50. The ultrasonic nebulizer assembly of claim 49, wherein the water outlet port includes a quick disconnect connector configured to be connected in fluid communication with the drain.

* * * * *

UNITED STATES PATENT AND TRADEMARK OFFICE

CERTIFICATE OF CORRECTION

PATENT NO. : 7,686,285 B2
APPLICATION NO. : 11/087209
DATED : March 30, 2010
INVENTOR(S) : Michael Louis Murray et al.

It is certified that error appears in the above-identified patent and that said Letters Patent is hereby corrected as shown below:

In column 10, line 1, change "as well the actual RH" to --as well as the actual RH--.

In column 12, line 16, change "a closed-bog air flow path" to --a closed-loop air flow path--, as appears in the After Final Amendment dated January 6, 2010 at Page 2, claim 1.

In column 12, line 37, change "a tray:" to --a tray;--.

In column 12, line 38, change "a ultrasonic nebulizer device" to --an ultrasonic nebulizer device--.

In column 13, line 55, change "a tray:" to --a tray;--.

In column 13, line 56, change "a ultrasonic nebulizer device" to --an ultrasonic nebulizer device--.

In column 14, line 58, change "a closed-bog air flow path" to --a closed-loop air flow path--, as appears in the After Final Amendment dated January 6, 2010 at Page 12, claim 44, now claim 26.

In column 15, line 39, change "a tray:" to --a tray;--.

In column 15, line 40, change "a ultrasonic nebulizer device" to --an ultrasonic nebulizer device--.

In column 16, line 45, change "a tray:" to --a tray;--.

In column 16, line 46, change "a ultrasonic nebulizer device" to --an ultrasonic nebulizer device--.

Signed and Sealed this

Tenth Day of August, 2010

David J. Kappos

David J. Kappos
*Director of the United States Patent and Trademark Office*